United States Patent [19]

Avery et al.

[11] Patent Number: 5,006,271

[45] Date of Patent: Apr. 9, 1991

[54] ORGANOSULFUR ADDUCTS AS MULTIFUNCTIONAL ADDITIVES FOR LUBRICATING OILS AND FUELS AND AS MULTIFUNCTIONAL LUBRICANTS

[75] Inventors: Noyes L. Avery, Bryn Mawr; Linda A. Benjamin, Horsham, both of Pa.; Andrew G. Horodysky, Cherry Hill, N.J.; Derek A. Law, Yardley, Pa.

[73] Assignee: Mobil Oil Corporation, Fairfax, Va.

[21] Appl. No.: 292,039

[22] Filed: Dec. 30, 1988

[51] Int. Cl.[5] ..... C10M 105/72; C10M 135/04

[52] U.S. Cl. ..... 252/45; 252/47; 44/62; 44/63; 44/72; 568/18; 568/21

[58] Field of Search ..... 44/62, 63, 72; 252/45, 252/47; 568/18, 21

[56] References Cited

U.S. PATENT DOCUMENTS

| | | | |
|---|---|---|---|
| 3,087,932 | 4/1963 | Little, Jr. | 252/47 |
| 3,471,404 | 10/1969 | Myers | 252/45 |
| 3,703,504 | 11/1972 | Horodysky | 568/18 |
| 3,703,505 | 11/1972 | Horodysky | 568/18 |
| 3,796,661 | 3/1974 | Suratwala et al. | 568/18 |
| 4,097,387 | 6/1978 | Caspari | 252/47 |
| 4,317,772 | 3/1982 | Spence | 252/47 |
| 4,320,017 | 3/1982 | Spence | 252/47 |
| 4,344,854 | 8/1982 | Davis et al. | 252/47 |

*Primary Examiner*—Margaret B. Medley

*Attorney, Agent, or Firm*—A. J. McKillop; C. J. Speciale; H. M. Flournoy

[57] ABSTRACT

Sulfurized propylene based lube olefin derivatives are superior lubricating fluids with internal synergistic multifunctional extreme pressure/antiwear and antioxidant properties as well as multifunctional extreme pressure/antiwear additives for both mineral and synthetic lubricating oils as well as fuels.

47 Claims, No Drawings

ORGANOSULFUR ADDUCTS AS MULTIFUNCTIONAL ADDITIVES FOR LUBRICATING OILS AND FUELS AND AS MULTIFUNCTIONAL LUBRICANTS

BACKGROUND OF THE INVENTION

This invention is directed to novel organosulfur adducts of propylene based lube olefins as unique multifunctional additives as well as multifunctional lubricants with inherent multifaceted internal synergism.

Lubricants, such as lubricating oils and greases, are subject to oxidative deterioration at elevated temperatures or upon prolonged exposure to the elements. Such deterioration is evidenced, in many instances, by an increase in acidity and in viscosity, and when the deterioration is severe enough, it can cause metal parts to corrode. Additionally, sever oxidation leads to a loss of lubrication properties, and in especially severe cases this may cause complete breakdown of the device being lubricated. Many additives have been tried, however, many of them are only marginally effective except at high concentrations. Improved antioxidants are clearly needed.

Antioxidants or oxidation inhibitors are used to minimize the effect of oil deterioration that occur when hot oil is contacted with air. The degree and rate of oxidation will depend on temperature, air and oil flow rates and, of particular importance, on the presence of metals that may catalytically promote oxidation. Antioxidants generally function by prevention of chain peroxide reaction and/or metal catalyst deactivation. They prevent the formation of acid sludges, darkening of the oil and increases in viscosity due to the formation of polymeric materials.

Additionally lubricants are under heavy distress that can affect their antiwear and load carrying ability particularly between steel on steel moving surfaces. Sulfurized olefins have been well known for their extreme pressure and antiwear properties when formulated into lubricants and fuels as noted by U.S. Pat. No. 3,703,50, and references contained within.

The use of phosphorodithioates, especially salts of phosphorodithioates, such as zinc dialkylphosphorodithioates (commonly known as zinc dithiophosphates) have found widespread commercial use for several decades in engine oils as multifunctional antiwear, peroxide decomposing, and bearing corrosion inhibiting additives.

Replacement of zinc dithiophosphates by zinc/phosphorus-free antiwear additives in hydraulic fluids, gear oils and various other lubricating systems is highly desirable because of environmental considerations. In addition, a sulfur-containing additive which overcomes the problems of odor, staining and volatility is also highly desirable. Finally, an additive system or fluid which exhibits antiwear activity in combination with antioxidant activity and copper passivation is highly desirous. Thus, it is an object of this application to generate compositions that when used either as a fluid media or additive imparts enhanced oxidative stability, reduced wear, increased load carrying capabilities and improved rust inhibition.

SUMMARY OF THE INVENTION

This application relates to the preparation of novel organosulfur compounds. More particularly, this application relates to the preparation of thioether adducts of propylene based lube (PBL) olefins. In one aspect, this application relates to novel compositions which are useful as a functionalized fluid. In another aspect, this application relates to compositions which are useful as lubricant additives in either mineral or synthetic fluids.

To the best of our knowledge, these compositions of matter or additive compounds have not been previously used as multifunctional additives in lubricating oils, greases or fuel applications. The additive products themselves and the compositions thereof, both fuel and lubricant are believed to be novel. The development of a new sulfurized olefin as possible replacement for traditional sulfurized isobutylene (SIB) or diisobutylene is also highly desirable.

It has now been discovered that the incorporation of sulfur onto the backbone of propylene based lube olefins provides the basis for the unique internal synergism leading to a lubricating fluid or additive with multifunctional properties.

DESCRIPTION OF PREFERRED EMBODIMENTS

Sulfurization of propylene based lube olefins with sulfur and/or hydrogen sulfide in the presence of a sulfur-containing heterocycle, e.g., dimercaptothiadazole, mercaptobenzimidazole, mercaptobenzothiazole, leads to products with enhanced sulfur and low corrosivity. These adducts should possess good antiwear and antioxidant properties. Because these adducts have a high molecular weight, high volatility is no longer a concern, in addition, color and odor are no longer a problem which is prevalent with the use of low molecular weight olefins. Adducts derived from propylene based lube olefin and phosphorus sulfides provide enhanced antioxidant antiwear properties from the synergism between the sulfur and phosphorus. Sulfurization with sulfur halides (e.g., $S_2Cl$, $S_2Cl_2$, etc.), leads to sulfochlorinated intermediates capable of undergoing additional chemical reactions. For example, the sulfochlorinated intermediate can be reacted with any mercaptan or heterocycle, as mentioned above, or undergo dehydrohalogenation. The intermediates may also be reacted with amines, functionalized amines or phosphorus containing compounds in order to achieve desired properties, e.g. dispersancy, detergency, EP/antiwear, antioxidant, emulsifier, demulsifier, corrosion inhibiting, antirust inhibitor, antistaining, friction reducing and the like.

Sulfurized olefins have been well known for their extreme pressure and antiwear properties when formulated into lubricants and fuels as noted by U.S. Pat. No. 3,703,50 and references contained therein. The products obtained from the reaction of a propylene based lube olefin and various distinct sulfur sources are unique not only in composition and structure but in utility. Part of the uniqueness is derived from the lube olefin itself; in that lube olefins are traditionally prepared from 1-decene to prepare oligomers, not propylene. The propylene based lube olefins were prepared in accordance with Mobil Docket No. 4715S, Ser. No. 140,361 entitled Olefin Oligomerization With Surface Modified Zeolite Catalyst, and now U.S. Pat. No. 4,870,038, in the following manner: propylene was oligomerized over 2,4,6-collidine modified HZSM-23 zeolite catalyst. The product consisting of $C_6$–$C_{30}$ olefins was distilled and the $\geqq C_{12}+$ fraction was oligomerized over HZSM-5 zeolite catalyst. This product was distilled to give the resultant lube olefin. The lube olefins have a MW range from about 300 to 6,000 more preferably from about 350 to 2,000. Therefore, the products from the sulfurization of these unique lube olefins are themselves unique and not evident in prior art.

Propylene based lube olefins may be prepared in any manner known to those skilled in the art, however, as noted hereinabove one suitable way is a method disclosed in the above referred to co-pending application. After the lube olefin has been prepared, sulfur and a co-reactant are incorporated onto the backbone thereof to give the resultant sulfurized lube olefin.

Any suitable organosulfur or sulfur-containing heterocycle compounds such as mercapto-heterocycles include but are not limited to mercaptothiadiazole and mercaptobenzo-thiazoles such as 3,4-dimercapto-1,2,5-thiadiazole, 3,5-dimercapto-1,2,4-thiadiazole, 4,5-dimercapto-1,2,5-thiadiazole, 4,5-dimercaptobenzo 1,2,3-thiadiazole, 4,7-dimercaptobenzo 1,2,3-thiadiazole, 4,6-dimercaptobenzo 1,2,3-thiadiazole, 5,6-dimercaptobenzo, 1,2,3-thiadiazole, 5,7-dimercaptobenzo 1,2,3-thiadiazole, 6,7-dimercaptobenzo 1,2,3-thiadiazole, 4,5-dimercaptobenzo 2,1,3-thiadiazole, 4,6-dimercaptobenzo 2,1,3-thiadiazole, 5,6-dimercaptobenzo 2,1,3-thiadiazole, 5,7-dimercaptobenzo 2,1,3-thiadiazole, 6,7-dimercaptobenzo 2,1,3-thiadiazole. Especially preferred is 2,5-dimercapto-1,3,4-thiadiazole. Other suitable mercapto heterocycles include mercaptobenzimidiazoles, mercaptobenzoates and mercaptobenzothiazoles.

Approximately 80% and more preferably 95% of this propylene based lube olefin material had a boiling point greater than or equal to 700° F. with about 70% of the total mixture having a boiling point greater than or equal to 750° F. These materials typically have VI's in the range of 30 to 125 and more preferably 100 to 115 with kinematic viscosity (100° C.) of 4 to 7 cs. and more preferably 5.0 to 5.5 cs.

Post-reactions of these unique sulfurized olefins with a scavenger olefin can lead to a product with unequaled low corrosivity and improved solubility and performance properties. In addition, any post-reactions between the aforementioned products and any amine or nitrogen-containing polymers which contain at least one free amine group are novel and give unique multifunctional lubricants and lubricant additives.

Generally speaking the various reaction times, temperatures, pressures and quantities of reactive materials, unless specified otherwise, may vary widely and are not deemed to be critical. However, in the subsequent sulfurization reaction the temperature can vary widely from about 80° to about 225° C. under ambient or slightly higher pressures or up to about 12 hours or more, preferably about 2 hours. The molar ratios of propylene based lube olefin to the elemental sulfur may vary from about 1:1 to about 10:1 and the molar ratio of propylene base lube elemental sulfur to organosulfur compound (thioether or DMTD) may vary from about 30:1 to about 1:3.

Primarily, these additives are used in lubricating oils, such as petroleum mineral oils and synthetic hydrocarbon oils. Additionally, hydrocarbon fuels, such as the petroleum based fuels, i.e. gasoline, kerosene and heavier fuel oils, may require extreme pressure/antiwear activity, thermal stability and/or friction protection. The novel additives of this invention are useful in the above-mentioned media in concentrations of from 0.001 to about 10 wt. %, preferably 0.01 to 1.0 wt. %.

In addition to the novel lubricating additives hereof, many other additives are also used in lubricants to provide various desirable characteristics. Therefore, titled compounds of the present invention should be compatible with other commonly used additives such as: dispersants, detergent, viscosity index improvers, EP/antiwear additives, antioxidants, pour depressants, emulsifiers, additives, friction modifiers and the like.

Reaction products of propylene based lube olefins (PBL) with elemental sulfur exhibit excellent lubricating properties in conjunction with low odor, light color, non-staining, good extreme pressure/antiwear and friction reducing properties. Reaction products of PBL with elemental sulfur and a co-reactant, i.e., 2,5-dimercapto-1,3,4-thiadiazole (DMTD), exhibit all of the above-mentioned properties in addition to significantly improved antioxidant and corrosion inhibition properties.

The additives may be incorporated into any suitable lubricating media which comprises oils of lubricating viscosity, e.g., mineral or synthetic; or mixtures of mineral and synthetic oils or greases in which the aforementioned oils are employed as a vehicle or into such functional fluids as hydraulic fluids, brake fluids, power transmission fluids and the like. In general, mineral oils and/or synthetics, employed as the lubricant oil, or grease vehicle may be of any suitable lubricating viscosity range, as for example, from about 45 SSU at 100° F. to about 6000 SSU at 100° F., and, preferably, from about 50 to 250 SSU at 210° F. These oils may have viscosity indices from below zero to about 100 or higher. Viscosity indices from about 70 to about 95 are preferred. The average molecular weight of these oils may range from about 250 to about 800. Where the lubricant is to be employed in the form of a grease, the lubricating oil is generally employed in an amount sufficient to balance the total grease composition, after accounting for the desired quantity of the thickening agent and other additive components to be included in the grease formulation.

In instances where synthetic oil, or synthetic oils employed as the vehicle for the grease, are desired in preference to mineral oils, or in combination therewith, various compounds of this type may be successfully utilized. Typical synthetic vehicles include polyisobutylene, polybutenes, hydrogenated polydecenes, polypropylene glycol, polyethylene glycol, trimethylolpropane esters, neopentyl and pentaerythritol esters, di(2-ethylhexyl) sebacate, di(2-ethylhexyl) adipate, dibutyl phthalate, fluorocarbons, silicate esters, silanes, esters of phosphorous-containing acids, liquid ureas, ferrocene derivatives, hydrogenated mineral oils, chain-type polyphenyls, siloxanes and silicones (polysiloxanes), alkyl-substituted diphenyl ethers typified by a butyl-substituted bis (p-phenoxy phenyl) ether, phenoxy phenylethers, etc.

Fully formulated lubricating oils may include a variety of additives (for their known purpose) such as dispersants, detergents, inhibitors, antiwear agents, antioxidant, antifoam, pour depressant and other additives including phenates, sulfonates and zinc dithiophosphates. As hereinbefore indicated, the aforementioned additive compounds may be incorporated as multifunctional agents in grease compositions. When high temperature stability is not a requirement of the finished grease, mineral oils having a viscosity of at least 40 SSU at 150° F., and particularly those falling within the range from about 60 SSU to about 6,000 at 100° F. may be employed. The lubricating vehicles of the improved greases of the present invention, containing the above described additives, are combined with a grease forming quantity of a thickening agent. For this purpose, a wide variety of materials dispersed in the lubricating vehicle in grease-forming quantities in such degree as to impart to the resulting grease composition the desired consistency. Exemplary of the thickening agents that may be employed in the grease formulation are non-soap thickeners, such as surface-modified clays and silicas, aryl ureas, calcium complexes and similar materials. In general, grease thickners may be employed which do not melt and dissolve when used at the required temperature within a particular environment; soap thickeners such as metallic (lithium or calcium) soaps including hydroxy stearate and/or stearate soaps can be used however, in all other respects, any material which is normally employed for thickening or gelling hydrocarbon fluids or forming greases can be used in preparing the aformentioned improved greases in accordance with the present invention.

Included among the preferred thickening agents are those containing at least a portion of alkali metal, alkaline earth metal or amine soaps of hydroxyl-containing fatty acids, fatty glycerides and fatty esters having from 12 to about 30 carbon atoms per molecule. The metals are typified by sodium, lithium, calcium and barium. Preferred is lithium. Preferred members among these acids and fatty materials are 12-hydroxystearic acid and glycerides containing 12-hydroxystearates, 14-hydroxystearic acid, 16-hydroxystearic acid and 6-hydroxystearic acid.

Other thickening agents include salt and salt-soap complexes as calcium stearate-acetate (U.S. Pat. No. 2,197,263), barium stearate acetate (U.S. Pat. No. 2,564,561), calcium, stearate-caprylate-acetate complexes (U.S. Pat. No. 2,999,065), calcium caprylate-acetate (U.S. Pat. No. 2,999,066), and calcium salts and soaps of low-, intermediate- and high-molecular weight acids and of nut oil acids.

The additive products may also be incorporated into any suitable liquid fuel compositions, particularly liquid carbon fuel compositions. Included among liquid fuels suitable for use herein are alcohols, gasohols, gasolines, diesel and fuel oils when incorporated into fuel compositions from about 25 to about 500 lbs of the additive and preferably from about 50 to about 150 lbs may be incorporated into about 1000 barrels of the fuel.

As noted hereinabove, propylene based lube olefins with sulfur and/or a sulfur containing heterocycle such as dimercaptothiadiazole etc., can function as replacement fluids or a complete lube oil itself. Compositions functioning in this manner can contain from about 50 to about 90 to 100% of the propylene based lube oil sulfurized composition. Generally speaking the PBL has a MW of from about 300 to about 6,000 and preferably from 400 to 2,000.

The following examples are exemplary only and are not intended as limitations.

EXAMPLE 1

A suspension of 30 g (0.08 mole) of a propylene based lube olefin and 1.21 g (0.04 mole) of sulfur was heated to 140° C. in a stirred, glass reactor under a nitrogen sparge. The reaction mixture was held at 140° C. for 2.5 hr. The reaction mixture was then cooled to room temperature at which time 100 ml of hexane was added and stirred for 0.5 h. The reaction mixture was filtered to remove any unreacted sulfur. The product was then vacuum filtered thru diatomaceous clay and volatiles were removed in-vacuo to yield a clear yellow oil (29.12 g). The product had the following elemental analysis:

% S=1.50

EXAMPLE 2

The procedure of Example 1 was repeated using 30 g (0.08 mole) of a propylene based lube olefin and 0.24 g (0.008 mole) of sulfur. The product was a clear yellow oil (28.98 g) and had the following elemental analysis:

% S=0.900

EXAMPLE 3

The procedure of Example 1 was repeated using 30 g (0.08 mole) of a propylene base lube olefin, 1.21 (0.04 mole) of sulfur and 1.14 g (0.008 mole) of 2,5-dimercapto-1,3,4-thiadiazole. The product was a clear yellow oil (27.96 g) and had the following elemental analysis:

% S=3.4

Performance as Antiwear Additive/Functionalized Fluids

The products of the above examples were evaluated as functional fluids. The results were compared to a standard test mineral as well as the un-derivatized lube olefin. These data were obtained on the Four-Ball Wear Apparatus (2000 rpm, 200° F., 60 kg). For additional information see test Method ASTM D2266, U.S. Pat. No. 4,761,482.

TABLE 1

| | Wear Scar (mm) |
|---|---|
| Test Oil (80/20 mixture of solvent paraffinic bright/solvent paraffinic neutral lubricating oils.) | 3.79 |
| PBI Lube Olefin (Underivatized) | 5.225 |
| Example 1 | 2.497 |
| Example 2 | 2.122 |
| Example 3 | 2.657 |

The products of the above examples were also evaluated as additives at 1 wt. % concentration in a standard test mineral oil. The results were compared to the test oil without additive. These data were also obtained on the Four-Ball Wear Apparatus (2000 rpm, 200° F., 60 Kg).

TABLE 2

| | Additive Concentration, wt % | Wear Scar (mm) |
|---|---|---|
| Test Oil (solvent paraffic bright/solvent paraffin neutral mineral oil in 80/20 ratio) | 0 | 3.79 |
| PBO Lube Olefin (underivatized) | 1 | 4.51 |
| Example 1 | 1 | 1.78 |
| Example 2 | 1 | 2.12 |
| Example 3 | 1 | 1.60 |

Clearly the coupling of unique propylene based lube olefins with elemental sulfur and the presence/absence of DMTD as described in this patent application leads to novel lubricants and lubricant additives. These compositions have enhanced oxidative stability, reduced wear, increased load carrying capabilities and improved rust inhibition. They may be used as an additive in synthetic or mineral based stocks as well as fuels.

Although the present invention has been described with preferred embodiments, it is to be understood that modifications and variations may be resorted to, without departing from the spirit and scope of this invention, as those skilled in the art will readily understand. Such modifications and variations are considered to be within the purview and scope of the appended claims.

We claim:

1. An improved lubricant composition comprising a major amount of an oil of lubricating viscosity or grease or other solid lubricant prepared therefrom and a minor EP/antiwear and antioxidant additive amount of from about 0.001 to about 10% by weight of a reaction product of a propylene based oligomerized olefin lube oil prepared in the following manner: propylene is first oligomerized over 2,4,6-collidine modified HZSM-23 zeolite catalyst; the oligomerized product is distilled and the ≧to $C_{12}$+ fraction oligomerized over HZSM-5 zeolite catalyst to provide a propylene lube olefin having a MW of from about 300 to about 6,000 and thereafter reacting said lube olefin and elemental sulfur and optionally with an organosulfur compound wherein said reaction product is obtained under the following reaction conditions: temperatures which vary from about 80° to about 225° C., pressures which vary from about ambient to slightly higher and times which vary from 0.5 to about 12 hours or more, and wherein said organosulfur compound is selected from mercaptothiadiazoles, dimercaptothiadiazoles, mercaptobenzimidazoles, mercaptobenzoates and mercaptobenzothiadiazoles.

2. The compound of claim 1 wherein said propylene based oligomerized olefin lube oil has at 100° C. a kinematic viscosity of about 4 to 7 cs, a VI in the range of about 80 to 125 with 80 to 95% having a BP ≧700° F.

3. The composition of claim 2 wherein said propylene based oligomerized olefin lube oil has at 100° C. a kinematic viscosity of 5 to 5.5, a VI in the range of 100 to 215, and about 95% of the material has a BP ≧700° F.

4. The composition of claim 2 wherein the reactants are a propylene oligomerized olefin and elemental sulfur.

5. The composition of claim 2 wherein the reactants are propylene oligomerized olefin, elemental sulfur and an organosulfur compound.

6. The composition of claim 1 wherein the mercaptoheterocycle is a dimercaptothiadiazole.

7. The composition of claim 6 wherein the mercaptoheterocycle is 2,5-dimercapto-1,3,4-thiadiazole.

8. The composition of claim 1 wherein said heterocycle is a mixture of dimercaptothiadiazole.

9. The composition of claim 1 wherein said heterocycle is a mercaptobenzimidazole.

10. The composition of claim 1 wherein said heterocycle is a mercaptobenzothiadiazole.

11. The composition of claim 2 wherein the molar ratio of propylene oligomerized olefin to sulfur varies from about 1:1 to about 10:1.

12. The composition of claim 3 wherein the reactants are propylene oligomerized olefin, elemental sulfur and a mercaptoheterocycle.

13. The composition of claim 12 wherein the mercaptoheterocycle is 2,5-dimercapto-1,3,4-thiadiazole.

14. The composition of claim 13 wherein the molar ratio of sulfur to mercaptoheterocycle varies from about 30:1 to about 1:3.

15. The composition of claim 1 wherein the reactants are further reacted with an amine or nitrogen-containing polymer having at least one free amine group.

16. The composition of claim 15 wherein the reactants are propylene based lube olefin, elemental sulfur and amine or nitrogen-containing polymer.

17. The composition of claim 15 wherein the reactants are propylene based lube olefin, elemental sulfur and a dimercaptothiadiazole.

18. The composition of claim 17 wherein the dimercaptothiadiazole is 2,5-dimercapto-1,3,4-thiadiazole.

19. The composition of claim 2 wherein the molecular weight of the propylene based lube oil varies from about 300 to about 6,000.

20. The composition of claim 2 wherein the molecular weight of the propylene based lube oil varies from about 350 to about 2,000.

21. The composition of claim 3 wherein the molecular weight of the propylene based lube oil varies from about 300 to about 6,000.

22. The composition of claim 3 wherein the molecular weight of the propylene based lube oil varies from about 350 to about 2,000.

23. The composition of claim 1 wherein said oil of lubricating viscosity is selected from mineral oils, synthetic oils and mixtures of mineral and synthetic oils.

24. The composition of claim 23 wherein said oil is a mineral oil.

25. The composition of claim 24 wherein said oil is a synthetic oil.

26. The composition of claim 23 wherein said oil is a mixture of synthetic and mineral oils.

27. The composition of claim 1 wherein said composition is a grease composition.

28. A lubricant composition comprising up to about 100% of a product of reaction as described in claim 23.

29. A lubricant composition as described in claim 28 containing from about 50 to 100% of said reaction product.

30. A lubricant composition containing from about 10 to about 90 wt. % of a product of reaction as described in claim 23.

31. A product of reaction made by reacting a propylene based olefin oligomer lube oil having a MW from about 300 to about 6,000 prepared in the following manner: propylene is first oligomerized over 2,4,6-collidine modified HZSM-23 zeolite catalyst; the oligomerized product thereof is distilled and the ≧$C_{12}$+ fraction is oligomerized over HZSM-5 zeolite catalyst and thereafter reacted with elemental sulfur and optionally an organosulfur compound selected from mercaptothiadiazoles, dimercaptothiadiazoates, mercaptobenzimidazoles, mercaptobenzoates and mercaptobenzothiadiazoles, wherein said reaction product is produced by the following reaction conditions; temperatures which vary from about 80° to about 225° C., pressures which vary from ambient or autogenous to slightly higher and times which vary from about 0.5 to about 12 hours or more.

32. The product of claim 31 wherein said propylene based lube olefin oligomer has a molecular weight varying from about 350 to about 2,000.

33. The product of claim 31 wherein the reactants are a propylene based lube olefin and elemental sulfur.

34. The product of claim 33 wherein the molar ratio of propylene based lube olefin varies from about 1:1 to about 10:1.

35. The product of claim 31 wherein the reactants are the propylene based lube olefin, elemental sulfur and an organosulfur compound.

36. The product of claim 35 wherein the molar ratio of sulfide to organosulfur compound varies from about 30:1 to about 1:3.

37. The product of claim 35 wherein the mercapto heterocycle is a dimercaptothiadiazole.

38. The product of claim 31 wherein the organosulfur compound is 2,5-dimercapto-1,3,4-thiadiazole.

39. The product of claim 31 wherein about 80 to 95% of the propylene based lube olefin has a BP ≧700° F. and a kinematic viscosity at 100° C. of from about 4 to 7 cs with a VI of from about 80 to 125 and about 70% of the mixture has a B.P. ≧750° F.

40. The product of claim 39 wherein about 95% of the propylene based lube olefin has a B.P. ≧700° F. a kinematic viscosity of 5 to 5.5 and a VI of about 100 to 115.

41. The product of claim 31 wherein the reactants are further reacted with an amine or nitrogen-containing polymer having at least one free amine group.

42. The product of claim 35 wherein the reactants are further reacted with an amine or nitrogen-containing polymer having at least one free amine group.

43. The product of claim 41 wherein the organosulfur reactant is a dimercaptothiadiazole.

44. The product of claim 43 wherein the dimercaptothiadiazole is 2,5-dimercapto-1,3,4-thiadiazole.

45. The product of claim 40 wherein said propylene has a VI of from about 100 to 115.

46. A process for improving the fuel economy of an internal combustion engine comprising treating the moving parts therewith a product of reaction as described in claim 31.

47. A process of making a product suitable for use as a multifunctional lubricant composition or as multifunctional additive for a lubricant composition or fuel comprising reacting equimolar, less than molar or more than molar proportions of propylene based lube olefin and elemental sulfur and optionally an organophosphorus or mercaptoheterocycle compound at temperatures varying from about 80° to about 225° C., pressure varying from ambient to slightly higher or autogeneous for a time sufficient varying from about 0.5 to about 12 hours or more.

* * * * *